US008191337B2

(12) United States Patent
Moore

(10) Patent No.: US 8,191,337 B2
(45) Date of Patent: Jun. 5, 2012

(54) BLOWER TYPE STRETCH WRAPPER MODULE FOR COILS

(75) Inventor: Brian Moore, Newburgh, NY (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 308 days.

(21) Appl. No.: 12/314,392

(22) Filed: Dec. 10, 2008

(65) Prior Publication Data

US 2010/0139211 A1 Jun. 10, 2010

(51) Int. Cl.
*B65B 11/06* (2006.01)

(52) U.S. Cl. ..... 53/210; 53/204; 53/211; 53/409

(58) Field of Classification Search ..... 53/397, 53/399, 409, 419, 430, 441, 523, 528, 118, 53/556, 582, 587, 211, 204, 210
See application file for complete search history.

(56) References Cited

U.S. PATENT DOCUMENTS

| | | | | |
|---|---|---|---|---|
| 3,812,640 | A * | 5/1974 | Knott | 53/397 |
| 4,523,723 | A | 6/1985 | Kotzur | |
| 5,121,584 | A * | 6/1992 | Suter | 53/116 |
| 5,203,139 | A * | 4/1993 | Salsburg et al. | 53/430 |
| 5,470,026 | A | 11/1995 | Kotzur | |
| 5,678,778 | A | 10/1997 | Kotzur et al. | |
| 5,803,394 | A | 9/1998 | Kotzur | |
| 5,941,050 | A * | 8/1999 | Georgetti et al. | 53/399 |
| 5,979,812 | A | 11/1999 | Kotzur | |
| 6,098,378 | A * | 8/2000 | Wyatt | 53/430 |
| 7,249,726 | B2 | 7/2007 | Kotzur | |
| 7,469,520 | B2 * | 12/2008 | Lancaster et al. | 53/442 |
| 2002/0174626 | A1 * | 11/2002 | Lancaster et al. | 53/399 |
| 2007/0272346 | A1 * | 11/2007 | Shpik et al. | 156/171 |
| 2008/0277523 | A1 * | 11/2008 | Delmore | 242/536 |

* cited by examiner

*Primary Examiner* — Christopher Harmon
(74) *Attorney, Agent, or Firm* — R. J. Lasker, Esq.

(57) ABSTRACT

A stretch wrap device for delivering stretch wrap film to a coil of cable or other filament type product being wound on a rotating mandrel and a traversing assembly for delivering stretch wrap film to the coil of cable or other filament type product; the traversing assembly including a stretch wrap module for traversing parallel to the rotating mandrel; the stretch wrap module including a motor and roller assembly for contacting and transporting the stretch wrap film toward the rotating mandrel so that an end of the stretch wrap film engages the coil of cable or other filament type product, and the continued rotation of the mandrel causing the end of the stretch wrap film to cover the surface of the wound coil of cable or other filament type material; the stretch wrap module also includes a compressed air generator and air jets for supporting the end of the stretch wrap film with compressed air, the end of the stretch wrap film engaging the coil of cable or other filament type with the completion of the winding of the coil of cable or other filament type product.

3 Claims, 7 Drawing Sheets

BLOWER TYPE STRETCH WRAPPER MODULE FOR COILS

CROSS REFERENCE TO RELATED INVENTIONS

None

STATEMENT REGARDING FEDERALLY SPONSORED RESEARCH OR DEVELOPMENT

None

THE NAMES OF THE PARTIES TO A JOINT RESEARCH AGREEMENT

None

INCORPORATION-BY-REFERENCE OF MATERIAL SUBMITTED ON A COMPACT DISC

None

BACKGROUND OF THE INVENTION (1) Field of the Invention

This invention relates to devices for delivering stretch wrap film to a coil of cable or other filament type product.

(2) Description of Related Art

Previously known automated devices for stretch wrapping cable or other filament type product typically use a series of articulating motions to pull the stretch wrap film from a roll, engage it onto a rotating surface, cut the stretch wrap film and reset. The device of the invention accomplishes the same final package; however it does not require the same degree of articulating parts and is more compact than the known automated devices for stretch wrapping.

BRIEF SUMMARY OF THE INVENTION

The device of the invention delivers stretch wrap to a coil or other filament type product using a stretch wrap module mounted on a traversing assembly in proximity to the wound product. As the winding coil nears completion, the device advances the stretch wrap film using a motor and rollers that contact the stretch wrap film. The stretch wrap film is supported by compressed air that blows through a series of jets on the stretch wrap device. The stretch wrap film extends to meet the vertex created at the point the cable meets the coil.

Once the stretch wrap film encounters the rotating coil, the film becomes engaged with the cable as it is wound onto the coil. The compressed air that was suspending the advancing film is now turned off, as it is no longer needed. The film is no longer advanced by the stretch wrap motor at this point in the process.

The winding action of the mandrel on which the coil is wound pulls both the cable product and the stretch wrap, which is now under tension. Once the coil has been wound to its desired predetermined length, the cable product is cut. The stretch-wrapping module now traverses to lay the stretch wrap film in a diagonal manner to contain the ends of the wound coil. Once sufficient stretch wrap is applied to the coil, a cutter pivots upwardly and severs the stretch wrap leaving a small section positioned between the air delivery jets for the next cycle to begin. The stretch wrapped finished product can then be removed from the stretch wrap device.

BRIEF DESCRIPTION OF THE SEVERAL VIEWS OF THE DRAWINGS

The above objects, features and advantages are readily apparent from the following description of a preferred embodiment of the best mode of carrying out the invention when taken in conjunction with the following drawings, wherein.

DETAILED DESCRIPTION OF THE INVENTION

Figure 1:
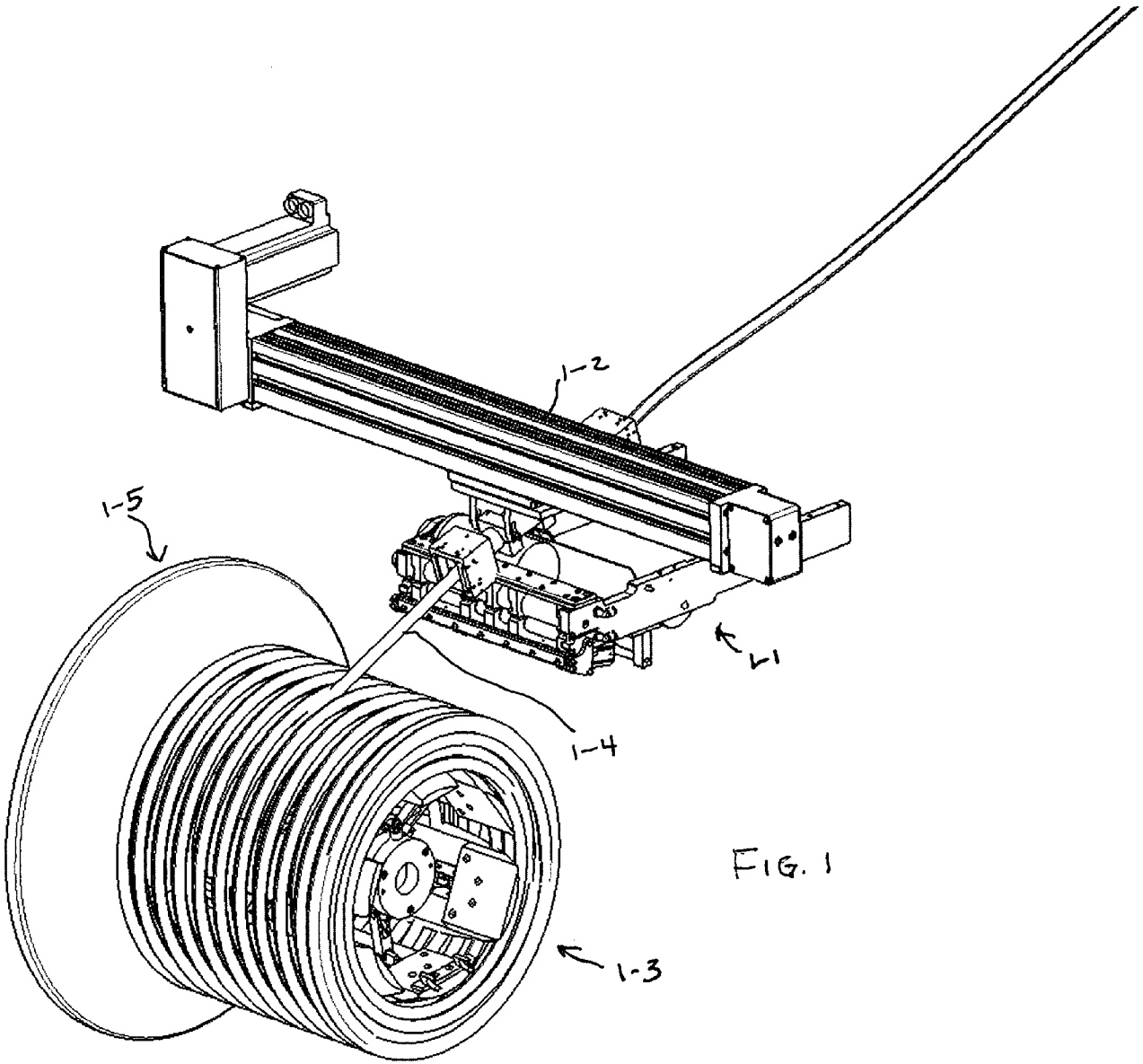
FIG. 1 is a perspective view of the traversing assembly, stretch wrap module and the cable or coil product being wound on a rotating mandrel.

The perspective view of FIG. 1 shows stretch wrap module 1-1 mounted to a traversing assembly in close proximity to rotating mandrel and with coil or cable product 1-4 being wound on mandrel 1-3. In turn, traversing assembly 1-2 is mounted to the frame of a winding machine (not shown) in a manner known to those skilled in the coil or filament winding technology. Only one endform 1-5 is illustrated on mandrel 1-3 for purposes of clarity. FIG. 1 shows the coil or cable product being wound over rotating mandrel 1-3. Traversing assembly 1-2 delivers the coil or cable product as required by the winding operation.

The cable or coil product illustrated in FIG. 1 is of the parallel wound type. However the stretch wrapper device of the invention operates on a figure eight or REELEX type coil as well. REELEX is the trademark of the assignee of the present invention. The REELEX type wind is described in the following patents owned by the assignee of the present application. U.S. Pat. Nos. 5,678,778 and 5,803,394, entitled: "Hi-Speed, Dual Head On-Line Winding Apparatus" and filed 24 Mar. 1995 and 4 Jun. 1997.

The stretch wrap module waits for the cable or coil wind to be completed.

Figure 2:
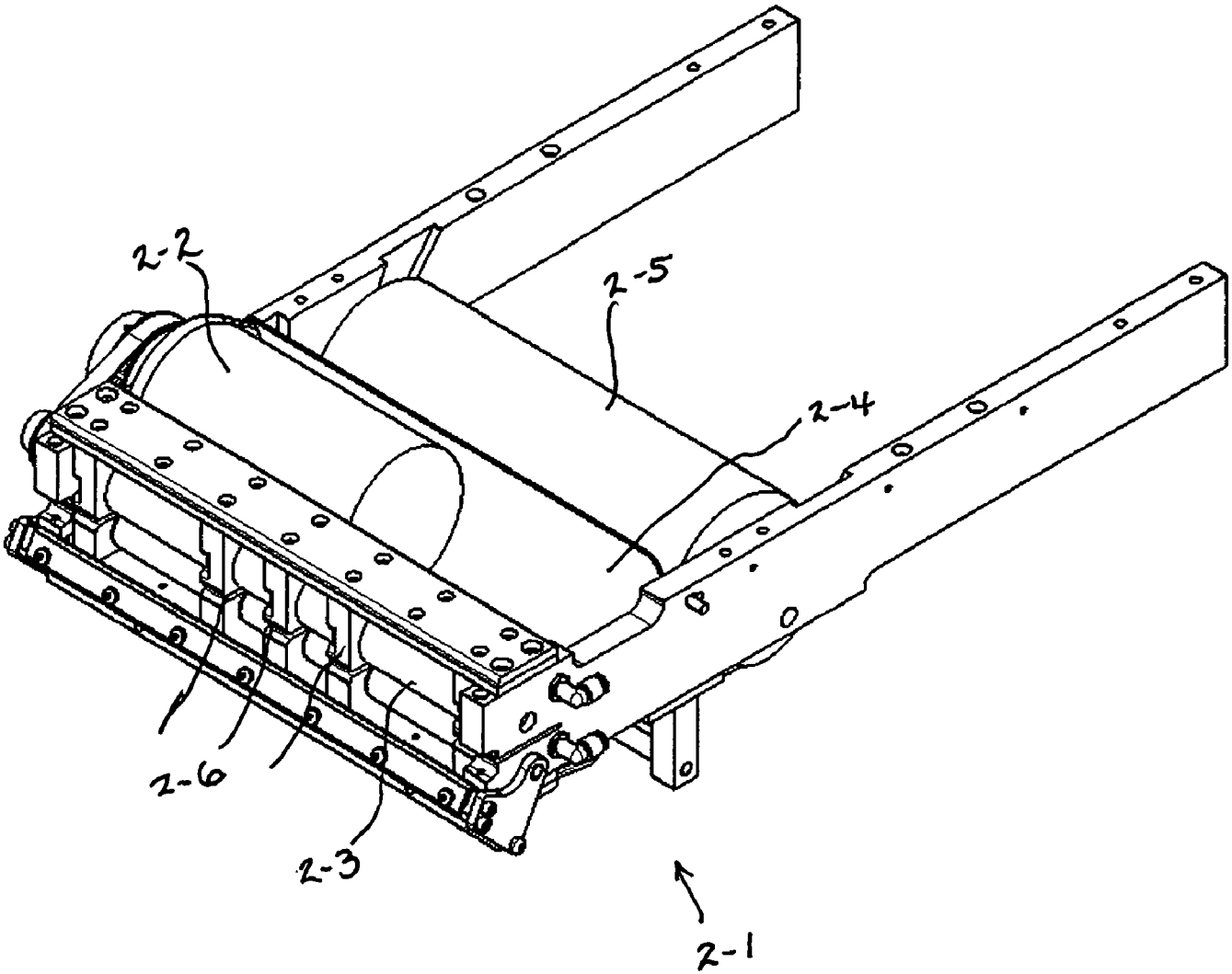
FIG. 2 is a perspective view of the stretch wrap supply roll, motor, air jets, rollers and cutter.
Figure 3:
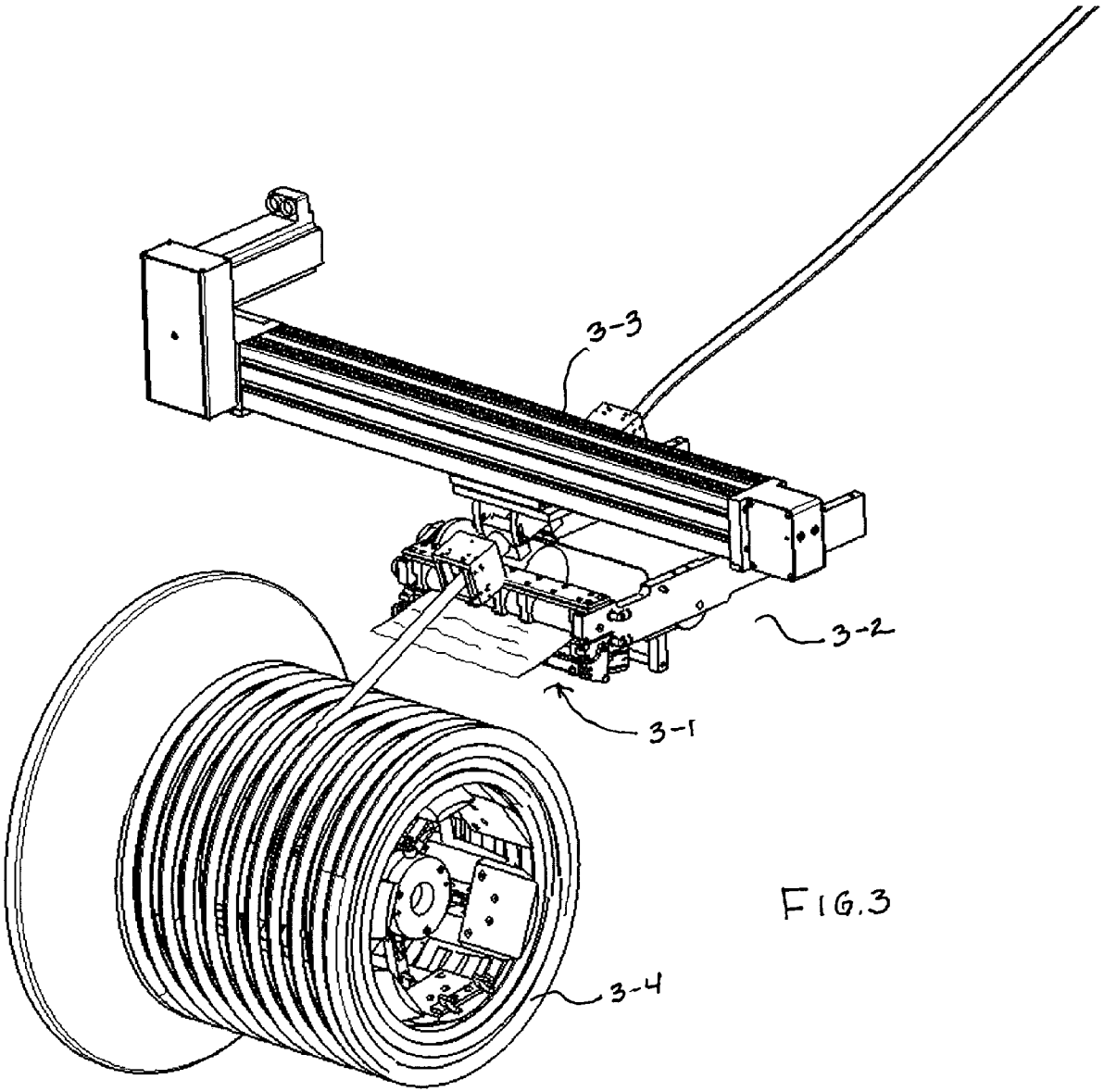
FIG. 3 is a perspective view of the stretch wrap film extending to meet the cable or coil product.

With respect to FIG. 2, as the winding coil nears completion, the stretch wrap device 2 advances the stretch wrap film using the motor 2-2 and rollers 2-3 that contact the stretch wrap film 2-4 being drawn from stretch wrap supply roll 2-5. The stretch wrap film 2-5 is supported by compressed air from a compressor (not shown) that blows through a series of air jets 2-6. The stretch wrap film extends to meet the vertex created at the point 3-1 where the cable meets the cable or coil as seen in FIG. 3. FIG. 3 also shows stretch wrap module 3-2, traversing assembly 3-3 and rotating mandrel with winding cable or coil 3-4.

Figure 4:
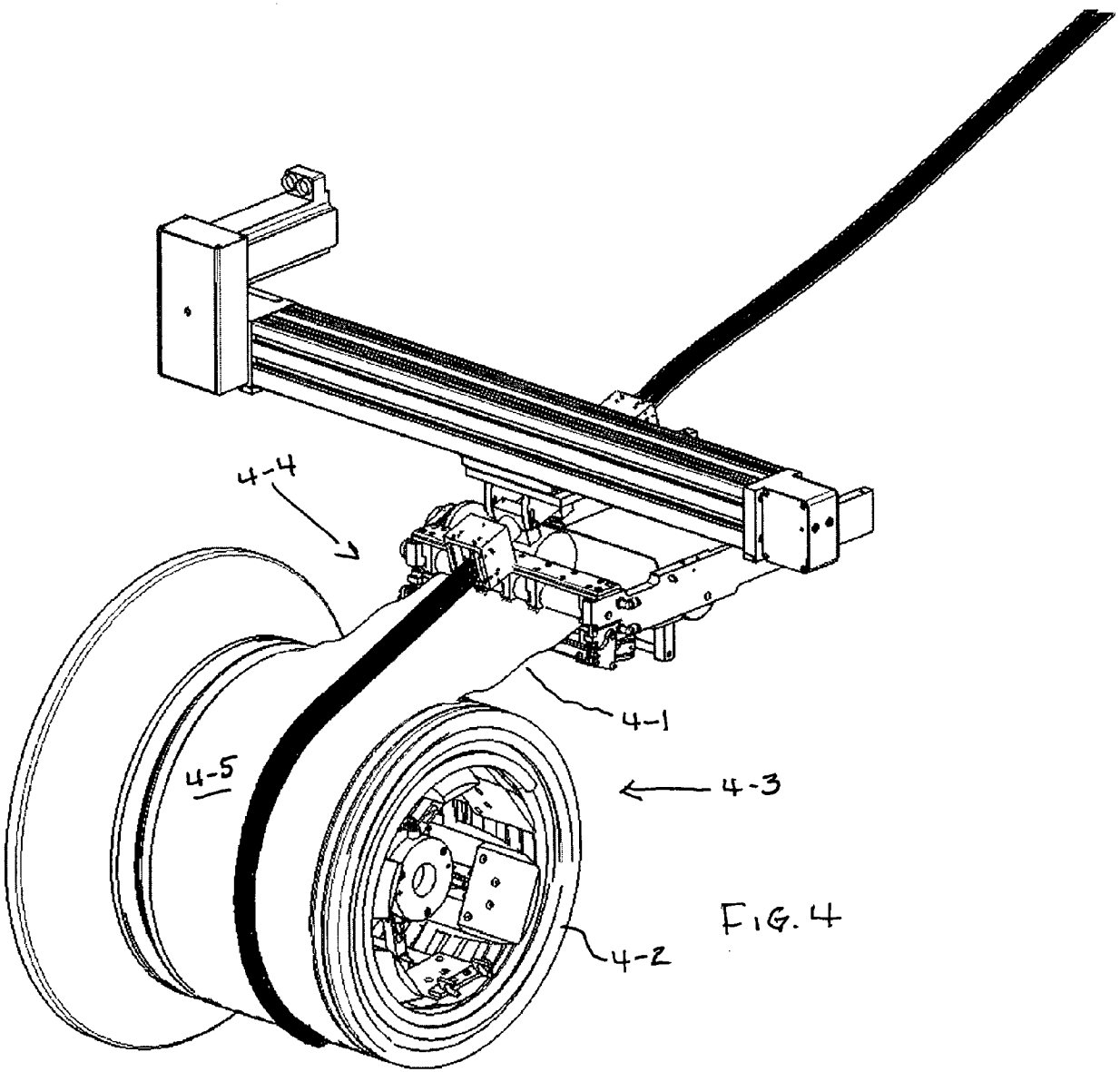
FIG. 4 is a perspective view of the stretch wrap film covering the surface of the winding cable or coil product while the cable or coil product continues to wind over the first layer of stretch wrap.
Figure 5:
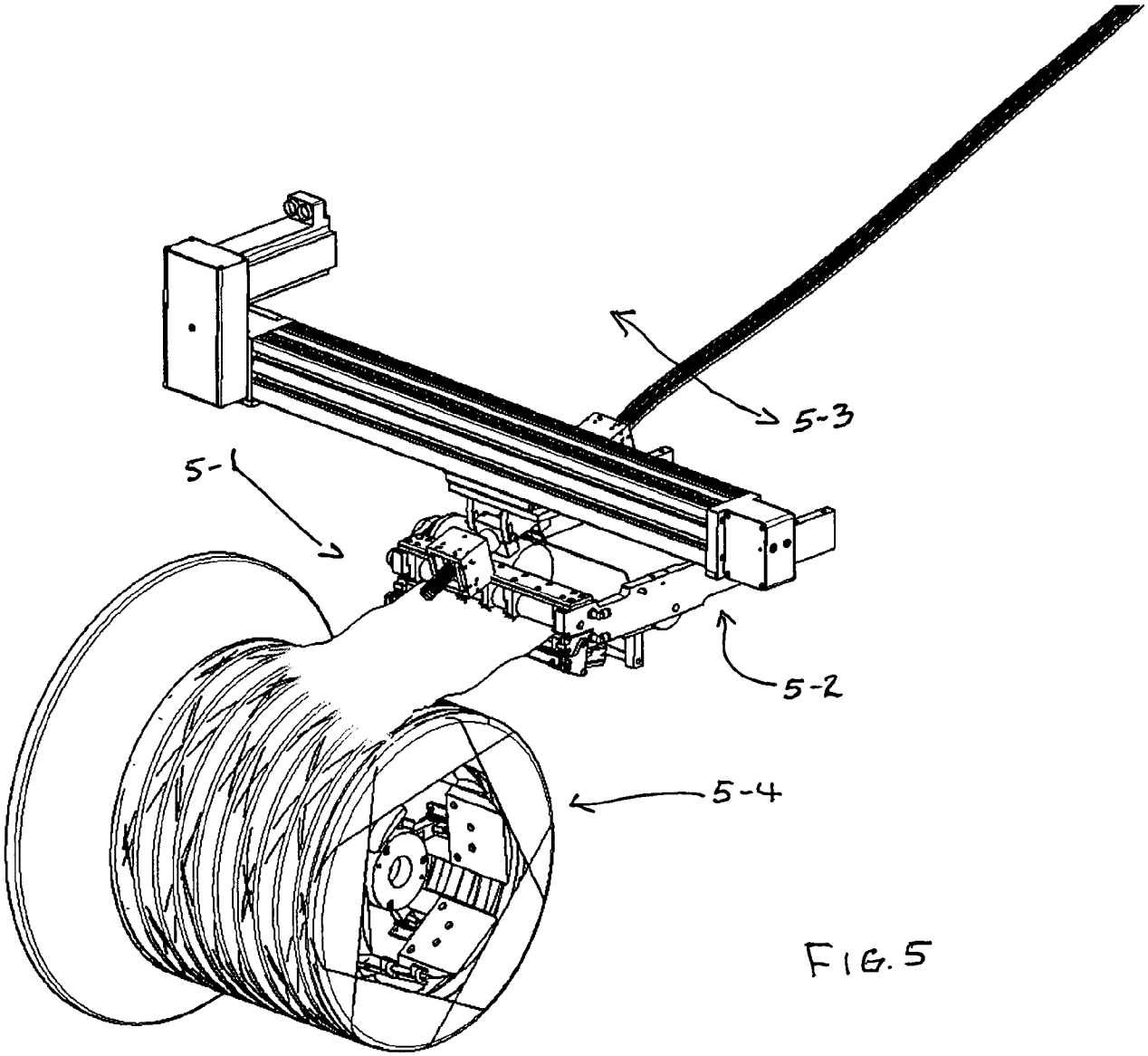
FIG. 5 is another perspective view showing the cable or coil product being cut to a desired length with the mandrel continuing to rotate, the stretch wrap module traverses to deliver film in a diagonal pattern, and the stretch wrap forms a diagonal pattern to contain the ends of the cable or coil product.

Once the stretch wrap film 4-1 engages the rotating cable or coil 4-2, the stretch wrap film 4-3 becomes engaged with the cable or coil as it is wound onto the cable or coil 4-2 The compressed air that was suspending the advancing film in now turned off, as it is no loner needed. It is no longer necessary to advance the film with the stretch wrap motor 2-2 (FIG. 2) at this point. The winding action 4-6 of the mandrel 4-5 is now pulling both the cable or coil product and the stretch wrap film which is now under tension as shown in FIG. 4.

Once the cable or coil product 5-1 has been wound to the predetermined length, the cable or coil product 5-1 is cut. The stretch wrap module 5-2 now traverses 5-3 to lay the stretch wrap film in a diagonal manner that encompasses the ends 5-4 of the cable or coil.

Figure 6:
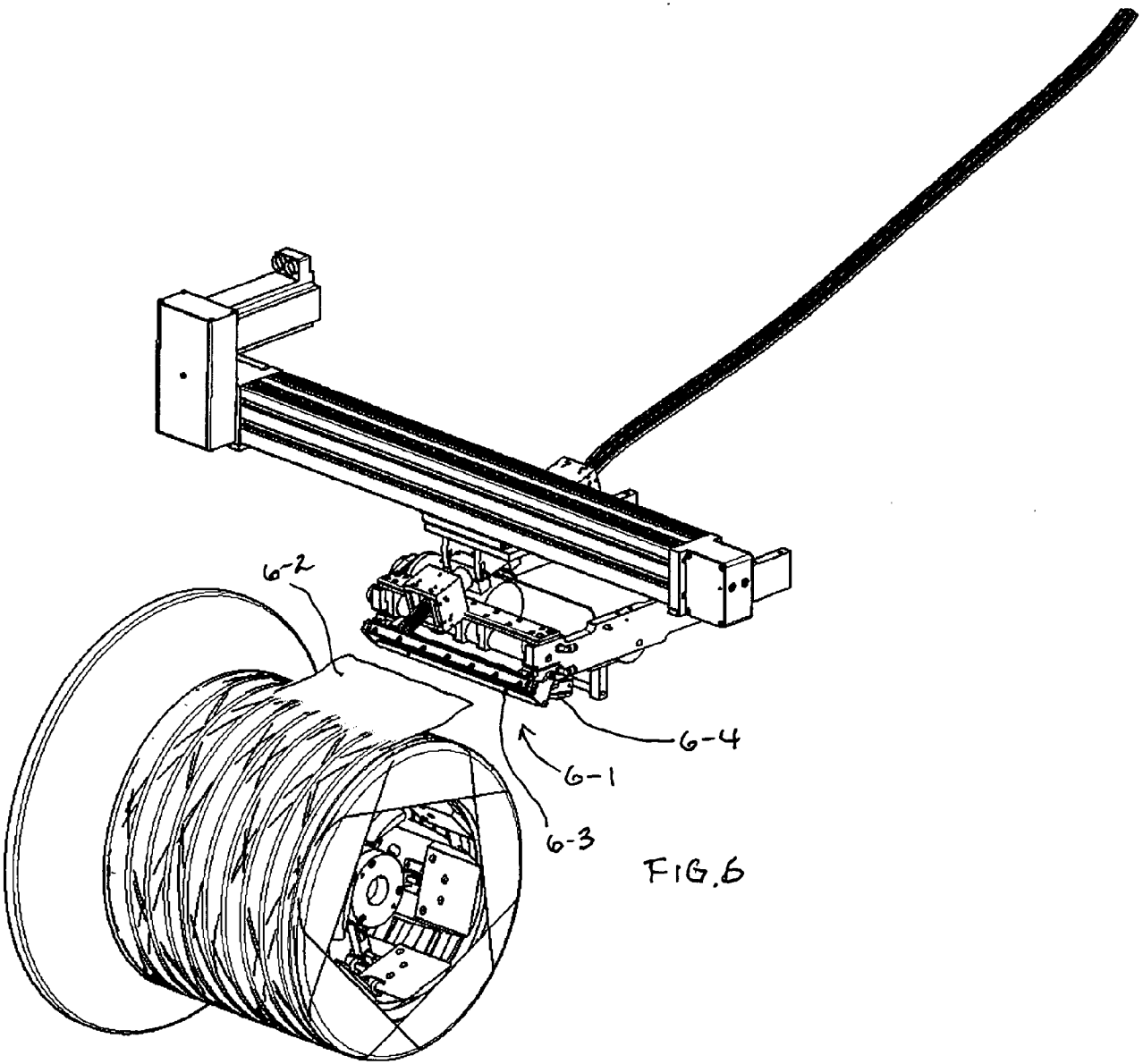
FIG. 6 shows the cutter mounted on the stretch wrap module in position to be pivoted upwardly to cut the stretch wrap film.

Once sufficient stretch wrap is applied to the cable or coil, cutter 6-1 extends and severs the stretch wrap film 6-2 leaving a small section positioned between the air delivery jets (as shown in FIG. 2 ). Cutter 6-4 pivots upwardly to cut the stretch wrap film (as shown in FIG. 6) for the next cycle to begin.

Figure 7:
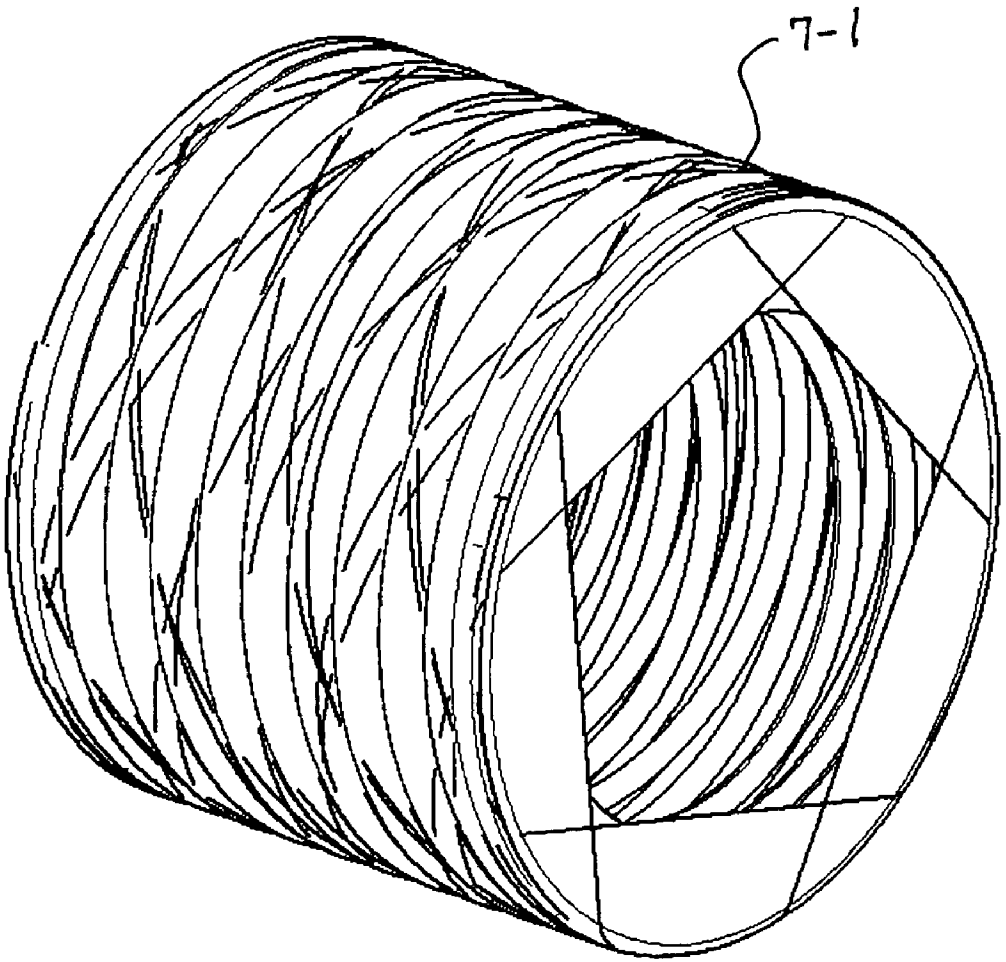
FIG. 7 shows the finished product of coil or other filament type material removed from the winding apparatus.

FIG. 7 shows the finished product 7-1 (cable or coil wrapped in the stretch wrap film) as it is removed from the winding apparatus.

The invention claimed is:

1. A stretch wrap device for delivering stretch wrap film to a coil of cable or other filament type product being wound on a rotating mandrel, comprising:

a stretch wrap module for delivering stretch wrap film to the surface of said coil of cable or other filament type product between the coil of cable or other filament type product being wound on the mandrel and the surface of the coil of cable or other filament type product being wound on the mandrel;

said stretch wrap module including an assembly for traversing said coil of cable or other filament type parallel to said rotating mandrel;

said stretch wrap module further including a motor and roller assembly for moving said stretch wrap film toward said rotating mandrel until an end of said stretch wrap film engages said coil of cable or other filament type product, said stretch wrap module further including a compressor for generating compressed air and air jets for supporting the end of the stretch wrap film with compressed air as the stretch wrap film moves toward the rotating mandrel;

the continued rotation of said mandrel causing the end of said stretch wrap film to cover the rotating surface of the wound coil of cable or other filament type material with said stretch wrap film; and said stretch wrap module further including a cutter mechanism for severing the stretch wrap film to cover only the surface of the coil of cable or other filament type product as the mandrel continues to rotate.

2. A stretch wrap device as set forth in claim 1, wherein said stretch wrap module traverses to lay the stretch wrap film in a diagonal manner encompassing the ends of the coil of cable or other filament type product.

3. A stretch wrap device for delivering stretch wrap film to a coil of cable or other filament type product being wound on a rotating mandrel according to claim 1, wherein said stretch wrap module delivers the stretch wrap film on the surface of the coil or cable or other filament type below the cable or other filament type being wound around the mandrel.

* * * * *